US008757322B2

(12) United States Patent
Peter

(10) Patent No.: US 8,757,322 B2
(45) Date of Patent: Jun. 24, 2014

(54) FOLDING SAWHORSE

(76) Inventor: Rosewicz Peter, Sussex, WI (US)

( * ) Notice: Subject to any disclaimer, the term of this patent is extended or adjusted under 35 U.S.C. 154(b) by 204 days.

(21) Appl. No.: 13/413,371

(22) Filed: Mar. 6, 2012

(65) Prior Publication Data

US 2013/0075197 A1 Mar. 28, 2013

Related U.S. Application Data

(63) Continuation-in-part of application No. 13/248,005, filed on Sep. 28, 2011, now abandoned.

(51) Int. Cl.
*E04G 1/32* (2006.01)

(52) U.S. Cl.
USPC ..... 182/153

(58) Field of Classification Search
USPC ..... 182/153
See application file for complete search history.

(56) References Cited

U.S. PATENT DOCUMENTS 5,010,978 A 4/1991 Jimmerson
5,012,893 A 5/1991 Kraeger
5,335,753 A 8/1994 Campbell
5,351,785 A 10/1994 DuRapau
5,560,448 A 10/1996 Yemini
6,164,413 A 12/2000 Sagol
6,422,343 B1 7/2002 Berg et al.
6,712,180 B2 3/2004 Levy
2006/0254858 A1 * 11/2006 Rosewicz ..... 182/153

OTHER PUBLICATIONS

U.S. Appl. No. 10/908,388, Nov. 16, 2006, Rosewicz, Peter J.
U.S. Appl. No. 13/248,005, Rosewicz, Peter J.

* cited by examiner

*Primary Examiner* — Alvin Chin-Shue
(74) *Attorney, Agent, or Firm* — Absolute Technology Law Group, LLC

(57) ABSTRACT

A folding sawhorse created by two pivotally connected frames containing a plurality of stress bearing structures on their inner surfaces forms a 60 degree angle when locked in place by a locking shelf. The frame components include two parallel vertical members separated at a distance by an upper horizontal brace and parallel lower horizontal brace. A U-shaped load bearing support is connected to the upper surface of the upper horizontal braces and provides four surfaces across which a load may be distributed when the folding sawhorse is in use. The trapezoidal locking shelf is pivotally connected to the lower horizontal braces and contains a central hinge, allowing the shelf to fold when the sawhorse is collapsed along its central vertical hinge.

20 Claims, 8 Drawing Sheets

54
58
34
26
40b
38
56
22
40a
42
36
30
12
32

12
42
56
30
20
58
14
54
16

80
34
26
38
40b
42
12
36
56
22
30
40a
18
16
32

42

12
36
90b
90a
90A
34
90A
40b
26
80
38
94
94
92a
92b
36
40a
2
16
16

42
26
16

30
49
20
50
49

30
50
20
49

20
49
49

20
49
49

FOLDING SAWHORSE

CROSS-REFERENCE TO RELATED APPLICATIONS

This application claims priority to and is a continuation-in-part of U.S. application Ser. No. 13/248,005, filed Sep. 28, 2011 now abandoned and titled "Folding Sawhorse," which is hereby incorporated by reference in its entirety. U.S. application Ser. No. 13/248,005 claims the benefit of U.S. application Ser. No. 13/156,326, which is a continuation of U.S. application Ser. No. 10/908,388, which applications are also hereby incorporated by reference in their entirties.

FIELD OF INVENTION

The present invention relates to sawhorses, scaffolds and trestles. In particular, the present invention relates to sawhorses that are opened for use and folded to collapse for storage.

TERMS OF ART

Figure 1:
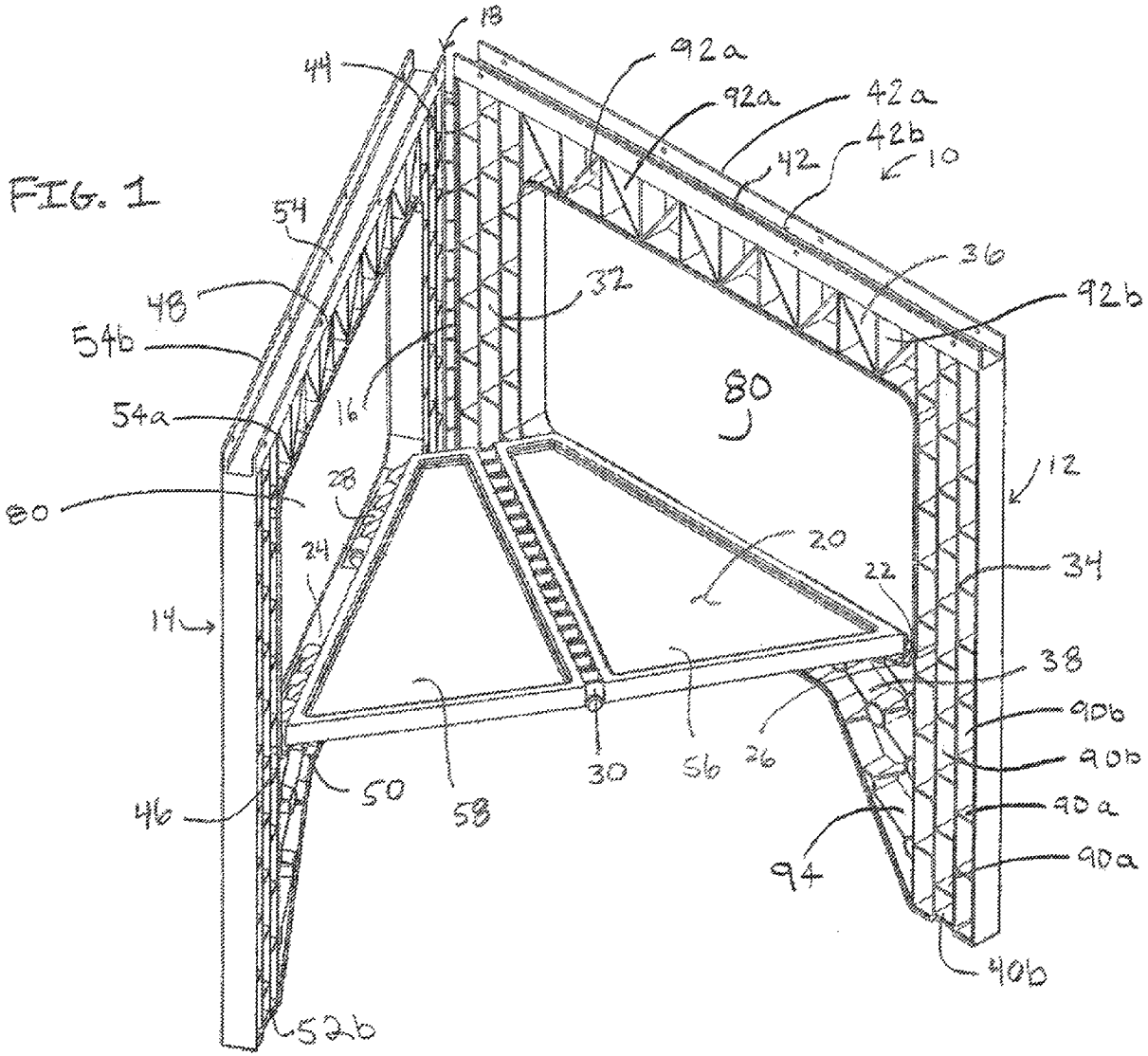
FIG. 1 is a front perspective view of a folding sawhorse according to the present invention.

As used herein, the term "stabilizing surface" refers to any structure or component of a folding sawhorse adapted to be in physical contact with the ground or other surface while the sawhorse is in use.

As used herein, the term "stress bearing structures" refers to any structure which supports or resists a loads or stress, including, but not limited to, bending, tensile stress and compression.

BACKGROUND

Sawhorses are used as racks or trestles to support construction materials and other objects. With their wide base, sawhorses provide stable support for a work piece while being portable. Non-folding sawhorses, however, require a substantial amount of space for storage and transportation. To ameliorate this problem, sawhorses were designed to fold and collapse.

Unfortunately, many current folding sawhorses are unable to withstand sideways motion in the load they support. In particular, folding sawhorses with legs positioned on a common side are not in rigid contact with each other which results in the legs pivoting with respect to the upper central member of the sawhorse when the sawhorse is under load.

Other folding sawhorse designs require the of two sawhorses to support working materials or equipment in a horizontal position. While providing adequate support, the necessity of having two separate sawhorses is cumbersome and onerous.

Therefore, what is needed is a single folding sawhorse that easily unfolds and supports a variety of working materials. What is further needed is a folding sawhorse that is capable of supporting a bad while withstanding the effects of lateral movement of the particular bad. Finally, what is needed is a folding sawhorse that is constructed from lightweight materials.

SUMMARY OF THE INVENTION

The present invention is a folding sawhorse comprised of two pivotally connected frames containing a plurality of stress bearing structures on their inner surfaces and forming a 60 degree angle when locking in place by a locking shelf. The frame components are comprised of two parallel vertical members separated at a distance by an upper horizontal brace and parallel lower horizontal brace. A U-shaped bad bearing support is connected to the upper surface of the upper horizontal braces and provides four surfaces across which a load may be distributed when the folding sawhorse is in use. The trapezoidal locking shelf is pivotally connected to the lower horizontal braces and contains a central hinge, allowing the shelf to fold when the sawhorse is collapsed along its central vertical hinge.

DETAILED DESCRIPTION OF INVENTION

For the purpose of promoting an understanding of the present invention, references are made in the text to exemplary embodiments of a folding sawhorse, only some of which are described herein. It should be understood that no limitations on the scope of the invention are intended by describing these exemplary embodiments. One of ordinary skill in the art will readily appreciate that alternate but functionally equivalent structures and materials may be used. The inclusion of additional elements may be deemed readily apparent and obvious to one of ordinary skill in the art. Specific elements disclosed herein are not to be interpreted as limiting, but rather as a basis for the claims and as a representative basis for teaching one of ordinary skill in the art to employ the present invention.

It should be understood that the drawings are not necessarily to scale; instead, emphasis has been placed upon illustrating the principles of the invention. In addition, in the embodiments depicted herein, like reference numerals in the various drawings refer to identical or near identical structural elements.

Figure 2:
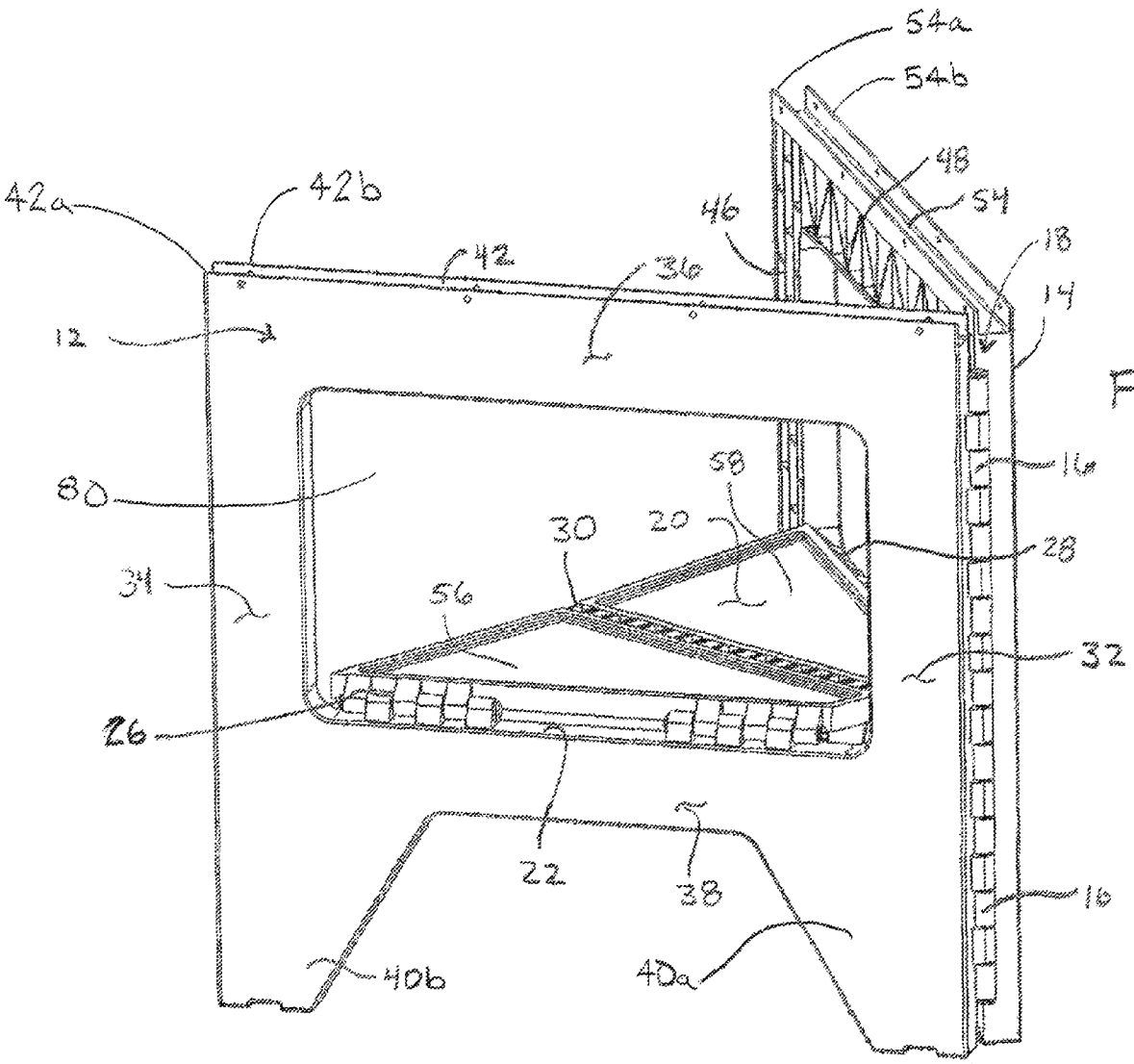
FIG. 2 is a back perspective view of a folding sawhorse.
Figure 3:
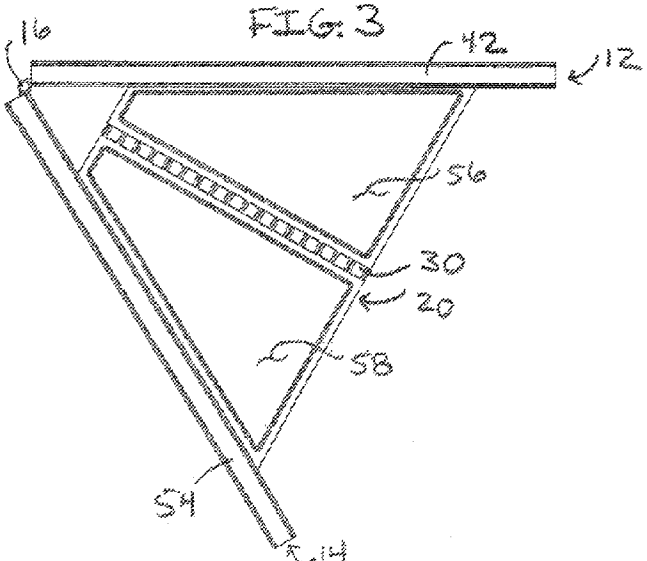
FIG. 3 is a top view of a folding sawhorse.

FIGS. 1-3 illustrate folding sawhorse 10 in the fully opened position. In the exemplary embodiment shown, folding sawhorse 10 is generally V-shaped with a first trestle frame 12 and a second trestle frame 14 connected to one another with a central hinge 16.

Frames 12 and 14 are generally rectangular having central rectangular apertures 80 and legs 40*a*, 40*b* and 52*a*, 52*b* projecting downward from frames 12 and 14, respectively. In the exemplary embodiment shown, legs 40*a*, 40*b* and 52*a*, 52*b* are integral with frames 12 and 14, respectively. However, in further exemplary embodiments, legs 40*a*, 40*b* and 52*a*, 52*b* may be separate physical components of folding sawhorse 10 which may be permanently or removably interconnected with frames 12 and 14.

As illustrated, legs 40*a*, 40*b* and 52*a*, 52*b* work together to create a three-point contact with the ground or other surface for while sawhorse 10 is in use. Legs 40*a* and 52*a*, closest to central hinge 16, act as a single stabilizing surface, while legs 40*b* and 52*b*, furthest from central hinge 16, act as distinct stabilizing surfaces.

Also illustrated in FIGS. 1-3 are the surfaces of frames 12 and 14. In the exemplary embodiments shown, frames 12 and 14 contain smooth outer surfaces while the inner surfaces contain a plurality of structural trusses, struts and other stress-bearing structures molded within frames 12 and 14.

As illustrated, there are three types of stress-bearing structures included on each of frames 12 and 14. Running vertically from legs 40*a*, 40*b* and 52*a*, 52*b* to the top of frames 12 and 14 are horizontal supports 90*a*, which are alternately aligned between vertical supports 90*b*. Horizontal supports 90*a* and vertical supports 90*b* spread and distribute force horizontally over legs 40*a*, 40*b* and 52*a*, 52*b* so that weight (when folding sawhorse 10 is in use) is evenly distributed on legs 40*a*, 40*b* and 52*a*, 52*b*. Frames 12 and 14 also contain diagonal braces 92*a* with vertical struts 92*b* running horizontally above the frame apertures 80. The diagonal braces 92*a* with vertical struts 92*b* work to distribute weight evenly across load bearing supports 42 and 54. Finally, the lower portions of frames 12 and 14 contain diamond-shaped support structures 94 which help evenly distribute weight from load bearing supports 42 and 54 and shelf 20 between legs 40*a*, 40*b* and 52*a*, 52*b*.

A center folding shelf 20 controls the opening and closing movements of frames 12 and 14. Shelf 20 is attached to a lower strut 22 on frame 12 and a lower strut 24 on frame 14. In particular, shelf 20 is interconnected with strut 22 with a shelf hinge 26 and with strut 24 with shelf hinge 28. Shelf 20 further includes a central shelf hinge 30 and is generally trapezoidal. Shelf 20 locks sawhorse 10 in an open stable position while also providing a surface upon which a user may place tools and parts associated with a particular job.

In the exemplary embodiment illustrated, shelf 20 contains a lip to prevent items from rolling on shelf 20. However, in other further embodiments, shelf 20 may omit lip. In still further exemplary embodiments, shelf 20 may contain apertures or compartments to accommodate specific tools or accessories commonly used in the art.

Figure 4:
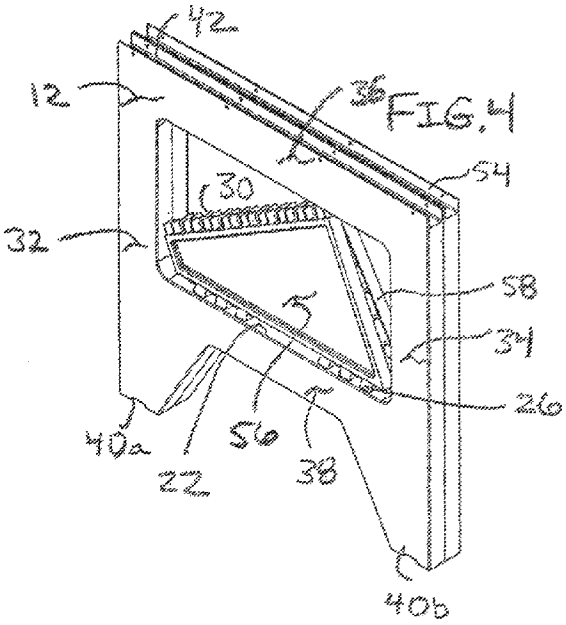
FIG. 4 is a perspective view of a folding sawhorse in a closed position.
Figure 5:
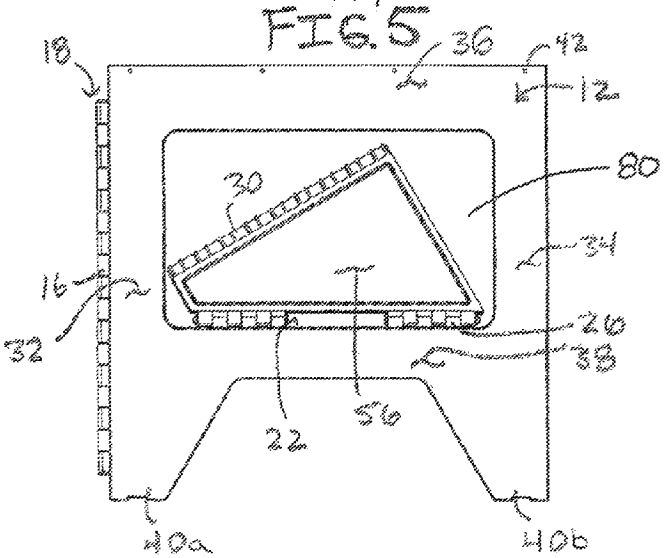
FIG. 5 is a side view of a folding sawhorse in a closed position.

FIGS. 4-5 illustrate folding sawhorse 10 in closed position. In operation, sawhorse 10 is opened from a closed position (illustrated in FIGS. 4-5) by slightly spreading apart frames 12 and 14 to an unfolded working position (as illustrated in FIGS. 1-3). Sawhorse 10 remains in a locked open position without any additional latching mechanism until frames 12 and 14 are returned to a closed position by applying light upward pressure on central shelf hinge 30. Shelf 20 then roves upwardly, thereby causing frames 12 and 14 to pivot inwardly towards each other until frames 12 and 14 are in a closed position.

In the preferred embodiment, frame 12 includes a first vertical member 32 opposite and parallel to a second vertical member 34 having an upper horizontal brace 36 and a lower horizontal brace 38 orthogonally configured therebetween. A pair of parallel spaced apart legs 40*a*, 40*b* extends from and is integrally formed with lower horizontal brace 38. A load bearing support 42 is formed along the top edge of upper horizontal brace 36.

Similarly, frame 14 includes a first vertical member 44 opposite and parallel to a second vertical member 46 having an upper horizontal brace 48 and a lower horizontal brace 50 orthogonally configured therebetween. A pair of spaced apart legs 52*a*, 52*b* extends from and is integrally formed with lower horizontal brace 50. A bad bearing support 54 is formed along the top edge of upper horizontal brace 48.

The inner surfaces of vertical members 32, 34, 44 and 46 contain horizontal supports 90*a* and vertical supports 90*b* (not shown). Upper horizontal braces 36 and 48 contain diagonal braces 92*a* with vertical struts 92*b* (not shown). Lower horizontal braces 38 and 50 contain diamond-shaped supports 94.

In the exemplary embodiments shown in FIGS. 1-5, load bearing supports 42 and 54 are U-shaped, thereby forming a channel across the upper edges of horizontal braces 36 and 48, respectively. When folding sawhorse 10 is in use, an object placed across the top of folding sawhorse 10 will be in physical contact with the four upper surfaces (42*a*, 42*b* and 54*a*, 54*b*) of the U-shaped load bearing supports 42 and 54.

Frames 12 and 14 pivot about hinge axis 16 along vertical leg edge 18 parallel to legs 40*a*, 40*b* and 52*a*, 52*b* and perpendicular to braces 36, 38, 48 and 50. Trapezoidal shelf 20 includes a first side 56 interconnected via hinge 26 to lower horizontal brace 38 of frame 12, and a second side 58 interconnected via hinge 28 to lower horizontal brace 50 of frame 14.

In the open position, trapezoidal shelf 20 is perpendicular to central hinge 16 that interconnects frames 12 and 14, thereby resulting in a "V" shaped configuration between frames 12 and 14 connected at hinge 16. In a closed storage position, frame 12 is generally parallel to frame 14 with trapezoidal shelf 20 folded therebetween. In the open position, shelf 20 rigidly secures legs 40*a*, 40*b* and 52*a*, 52*b* in position so they do not move with respect to one another. The rigid positioning of legs 40*a*, 40*b* and 52*a*, 52*b* combined with central hinge 16 securing frame 12 to frame 14 prevents relative motion between the components of sawhorse 10, resulting in a rigid support structure designed to accommodate a substantial load.

In the exemplary embodiments shown, frames 12 and 14 have a length of 30 inches and a height of 31 inches. When locked in its open position, frames 12 and 14 create a 60 degree angle. Legs 40*a*, 40*b* and 52*a*, 52*b* are 4 inches wide by 1.75 inches deep, resulting in a surface area for each of 7 inches squared. Because legs 40*a*, 40*b* and 52*a*, 52*b* work together to create three stabilizing areas, the resulting stabilizing surfaces are 7 inches squared (for legs 40*b* and 52*b*) and 14 inches squared (for combined legs 40*a* and 52*a*).

While the above-dimensions are preferred, in further exemplary embodiments, frames 12 and 14 may have slightly variable dimensions. For example, frames 12 and 14 may be specifically manufactured for use with a certain material or weight. In some exemplary embodiments, the length and height of frames 12 and 14 may range between 25 and 35 inches. In most exemplary embodiments, frames 12 and 14 will have the same length and height.

Similarly, the 7-inches-squared surface area of legs 40*a*, 40*b* and 52*a*, 52*b* is preferred because a smaller surface area will not provide enough stability and it may be difficult to find a level surface to stabilize legs having a larger surface area. However, in further exemplary embodiments, the surface area of legs 40*a*, 40*b* and 52*a*, 52*b* may range from 5 to 10 inches squared.

In still further exemplary embodiments, frames 12 and 14 may create a different angle. For example, frames 12 and 14 may create an angle in the range of 50 to 70 degrees.

FIGS. 6-9 illustrate the separate components of frame 12, with frame 14 (not shown) being symmetrically formed. As previously described, load bearing support 42 is formed along top edge of upper horizontal brace 36. Central hinge 16 interconnects frame 12 with frame 14.

Figures 6, 7, 8, 9:
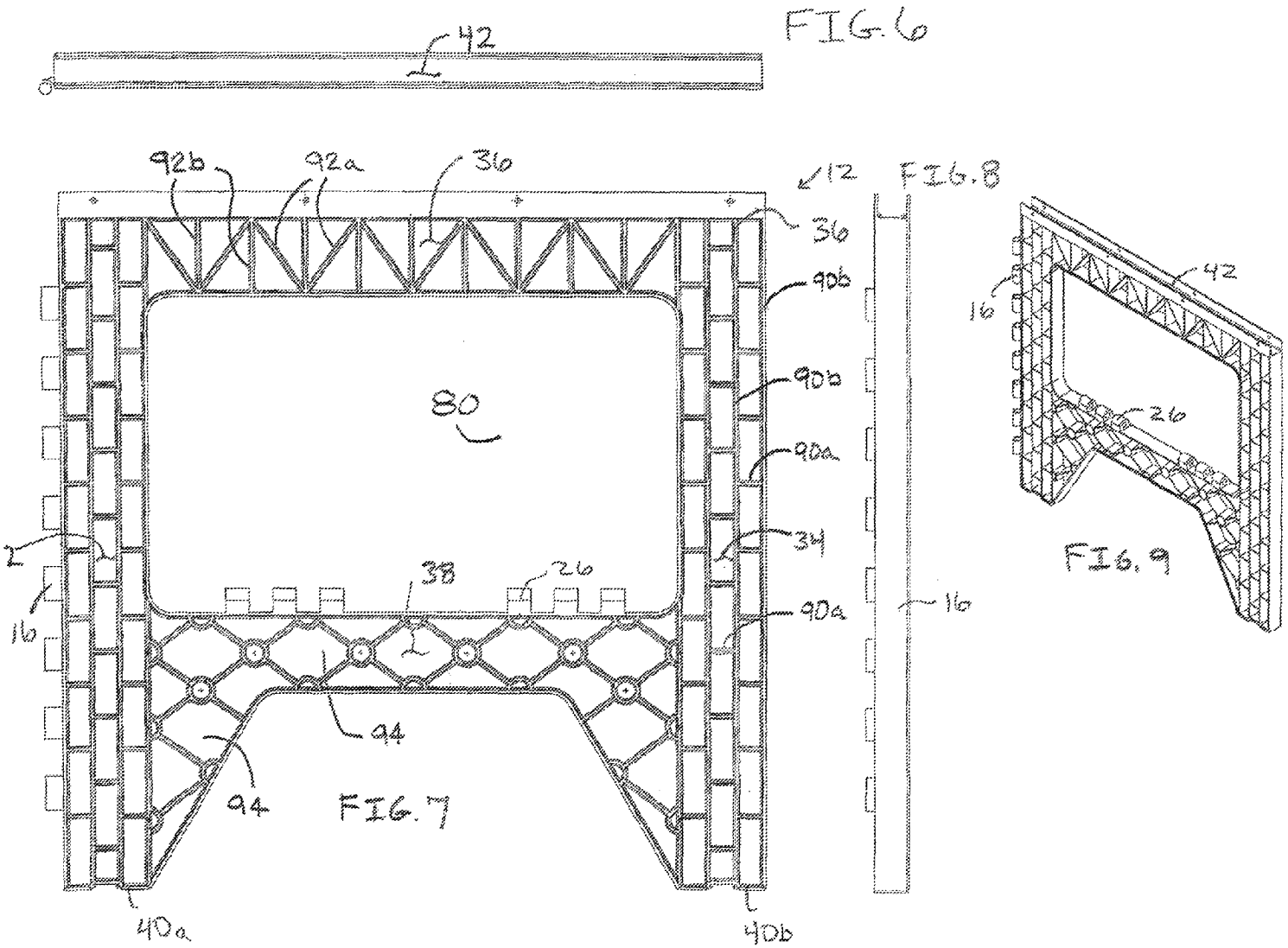
FIG. 6 is a top view of a load bearing support member of a folding sawhorse.
FIG. 7 is a side view of a frame of a folding sawhorse.
FIG. 8 is a side view of a hinge of a folding sawhorse.
FIG. 9 is a perspective view of a frame of a folding sawhorse.
Figure 13:
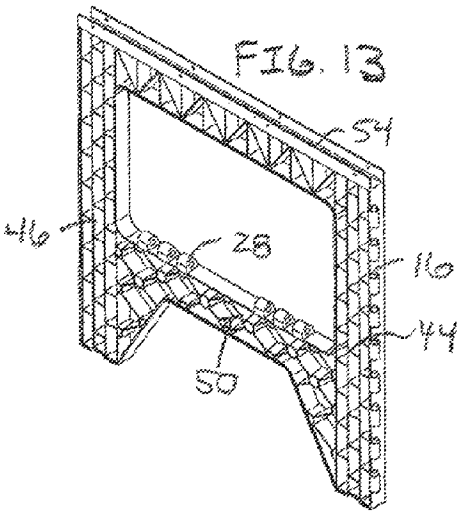
FIG. 13 is a perspective view of a frame of a folding sawhorse.
Figure 12:
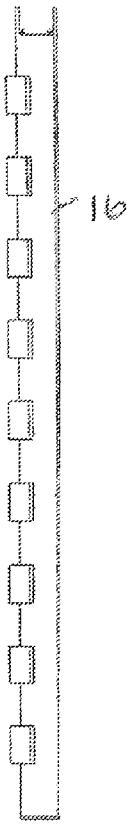
FIG. 12 is a side view of a hinge of a folding sawhorse.
Figure 10:
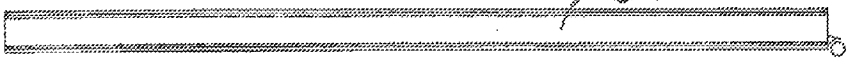
FIG. 10 is a top view of a load bearing support member of a folding sawhorse.
Figure 11:
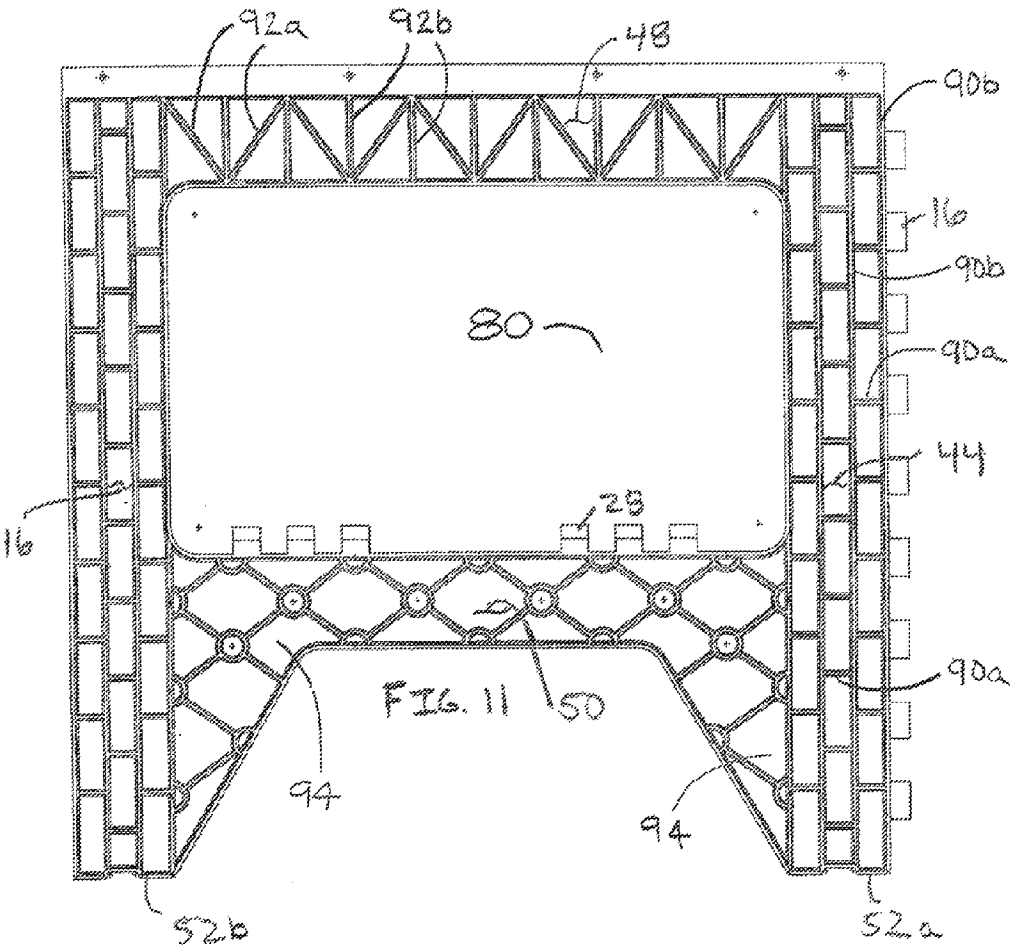
FIG. 11 is a side view of a frame of a folding sawhorse.
Figures 14, 15, 16, 17:
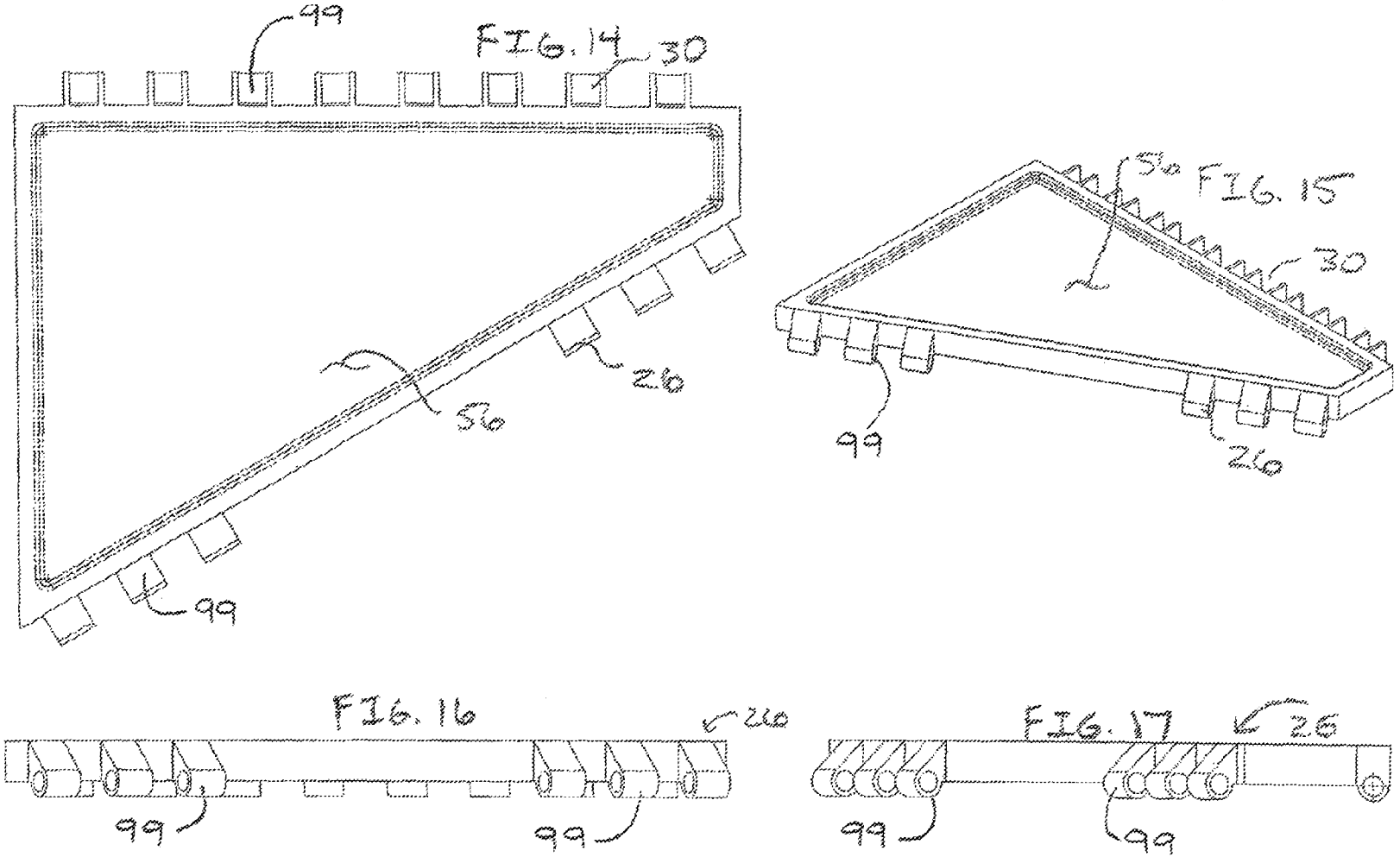
FIG. 14 is a top view of a shelf of a folding sawhorse.
FIG. 15 is a perspective view of a shelf of a folding sawhorse.
FIG. 16 is a perspective view of a hinge of a folding sawhorse.
FIG. 17 is a perspective view of a hinge of a folding sawhorse.
Figure 19:
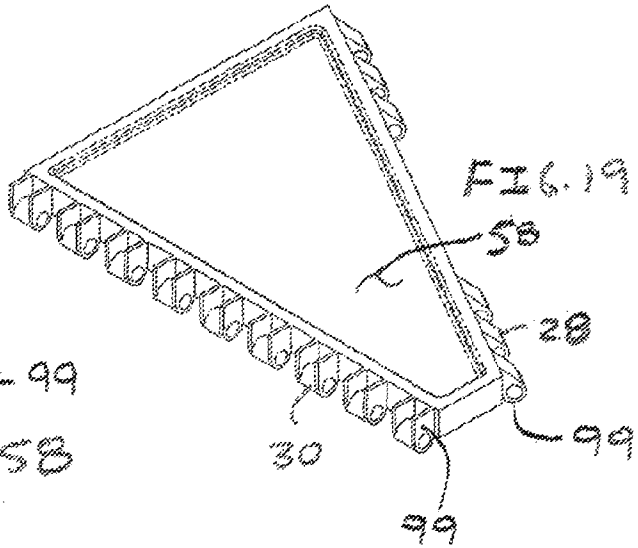
FIG. 19 is a perspective view of a shelf of a folding sawhorse.
Figure 21:
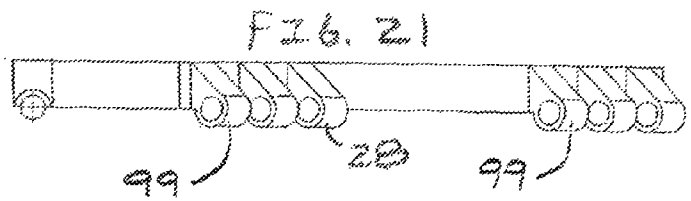
FIG. 21 is a perspective view of a hinge of a folding sawhorse.
Figure 18:
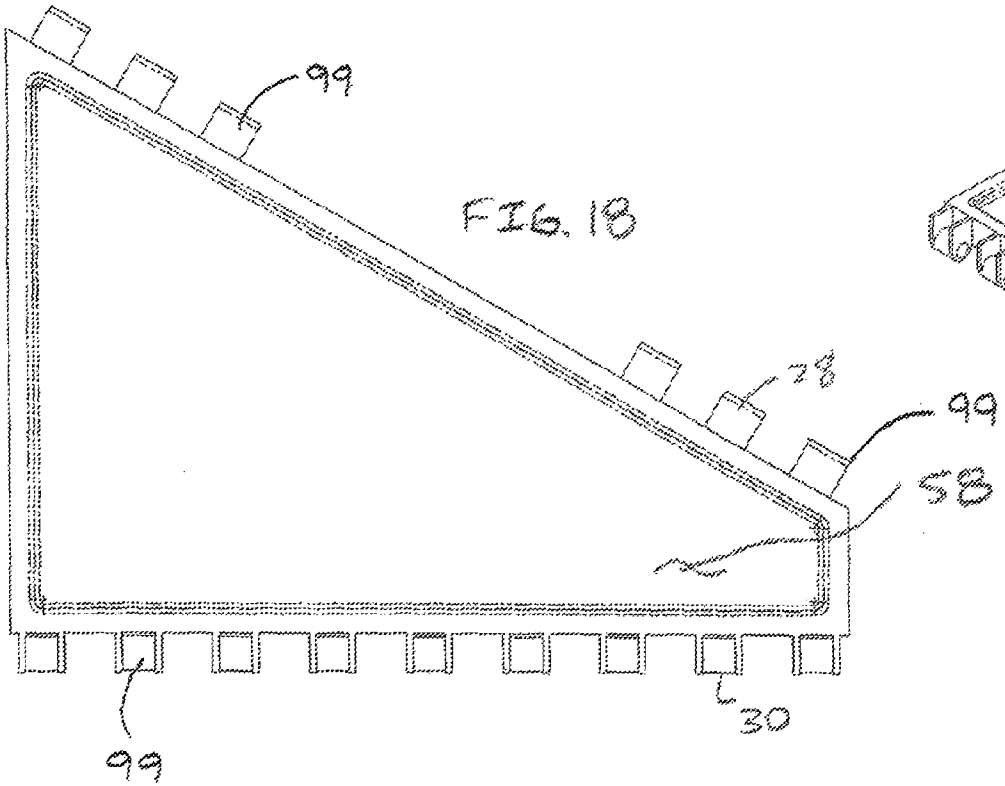
FIG. 18 is a top view of a shelf of a folding sawhorse.
Figure 20:
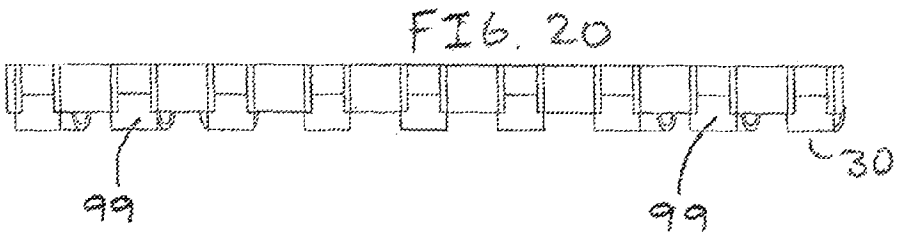
FIG. 20 is a perspective view of a hinge of a folding sawhorse.
Figure 22:
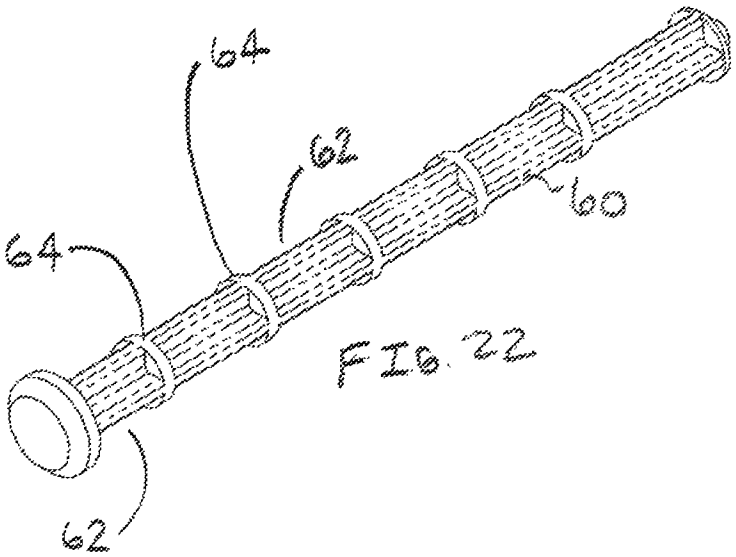
FIG. 22 is a perspective view of a tubular member of a hinge for a folding sawhorse.
Figure 23:
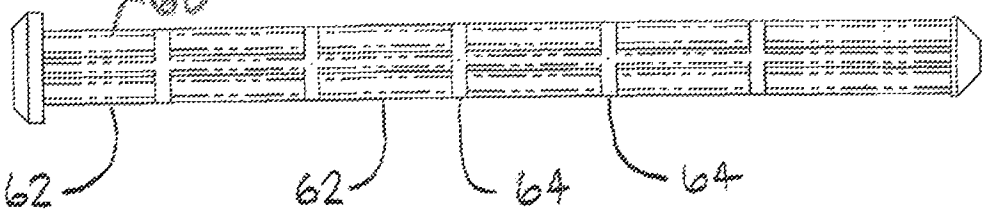
FIG. 23 is a side view of a tubular member of a hinge for a folding sawhorse.

FIG. 7 clearly illustrates the different stress bearing structures integrally molded with frame 12. The inner surfaces of vertical members 32, 34, 44 and 46 contain horizontal supports 90*a* (not shown) with vertical supports 90*b*. Upper horizontal braces 36 and 48 contain diagonal braces 92*a* (not shown) with vertical struts 92*b* (not shown). Lower horizontal braces 38 and 50 contain diamond-shaped supports FIGS. 14-17 illustrate the components of shelf side 56 of shelf 20. Central shelf hinge 30 connects side 56 to shelf side 58. Hinge 26 interconnects side 56 to frame 12. Similarly, as illustrated in FIGS. 18-21, central shelf hinge 30 connects side 56 to shelf side 58. Hinge 28 interconnects side 58 to frame 14. FIGS. 22 and 23 illustrate a tube member 60 which is part of hinge 16.

In the exemplary embodiments shown, hinges 30, 26 and 28 are created by a plurality of looped members 99 through which tube member 60 passes to form pivotal joints. As illustrated in FIGS. 22 and 23, tube member 60 is generally cylindrical having notched segments 62 alternated with smooth segments 64 and provides a surface around which frames 12 and 14 and shelf sides 56 and 58 may pivot to go from the open position to the closed position.

In the exemplary embodiments described, sawhorse 10 is manufactured from a lightweight plastic material. In further exemplary embodiments, however, sawhorse 10 may be manufactured from other materials, including wood. Similarly, shelf 20 is described in the exemplary embodiments as trapezoidal, but may be any other shape while still functioning as a locking mechanism between frame 12 and frame 14. Frames 12 and 14 may also be constructed as single continuous panels without separate vertical members and horizontal braces.

What is claimed is:

1. A folding sawhorse apparatus comprising:

two rectangular frame components, wherein said rectangular frame components have a smooth outer surface and an inner surface containing at least one stress bearing structure, each of said frame components comprised of a first vertical member and a second vertical member, each of said vertical members having an upper section and a lower section terminating in a stabilizing surface, wherein said first and second vertical members are parallel, an upper horizontal brace connecting said first vertical member and said second vertical member at said upper sections, a lower horizontal brace parallel with said upper horizontal brace and connecting said first vertical member and said second vertical member at said lower sections, and a U-shaped load bearing support connected to an upper surface of said upper horizontal brace, wherein said first vertical member, said second vertical member, said upper horizontal brace and said lower horizontal brace define a rectangular central aperture, and wherein one of said two frame components contains a plurality of looped members along one of its vertical members and the other of said two frame components contains a second plurality of looped members along the one of its vertical members;

a locking shelf comprised of a first side pivotally connected to said lower horizontal brace of one of said frame components, a second side pivotally connected to said lower horizontal brace of the other of said frame components, a central hinge pivotally connecting said first side and said second side; and a tubular member passing through said plurality and said second plurality of looped members and connecting said frame components in a V-shape with said inner surfaces facing each other when said folding sawhorse is in a locked position, wherein said frame components pivot inwardly about said tubular member to bring said inner surfaces in physical contact with each other.

2. The apparatus of claim wherein said stress bearing structures are selected from a group consisting of vertical supports, horizontal supports, diagonal braces, vertical struts, diamond-shaped support structures and combinations thereof.

3. The apparatus of claim 1 wherein said inner surfaces of said frame components contain horizontal supports and vertical supports on said first and second vertical members.

4. The apparatus of claim 3 wherein said horizontal supports are staggered.

5. The apparatus of claim 1 wherein said inner surfaces of said frame components contain vertical struts and diagonal braces on said upper horizontal braces.

6. The apparatus of claim 1 wherein said inner surfaces of said frame components contain diamond-shaped support structures on said lower horizontal braces.

7. The apparatus of claim 1 wherein said stabilizing surfaces create a three-point contact with a surface.

8. The apparatus of claim 1 wherein the surface area of each of said stabilizing surfaces is 7 inches squared.

9. The apparatus of claim 1 wherein said frame components have a length of 30 inches.

10. The apparatus of claim 1 wherein said frame components have a height of 31 inches.

11. The apparatus of claim 1 wherein said frame components form a 60 degree angle when in said locked position.

12. The apparatus of claim 1 wherein said locking shelf is trapezoidal.

13. A folding sawhorse apparatus comprising:

two rectangular frame components, wherein said rectangular frame components have a smooth outer surface, each of said frame components comprised of a first vertical member and a second vertical member having a plurality of vertical and horizontal supports, each of said vertical members having an upper section and a lower section terminating in a stabilizing surface having a surface area of 7 inches squared, wherein said first and second vertical members are parallel, an upper horizontal brace having a plurality of vertical struts and diagonal braces and connecting said first vertical member and said second vertical member at said upper sections, a lower horizontal brace having a plurality of diamond-shaped support structures, said lower horizontal bracing being parallel with said upper horizontal brace and connecting said first vertical member and said second vertical member at said lower sections, wherein said lower horizontal brace contains a plurality of looped members, and a U-shaped load bearing support connected to an upper surface of said upper horizontal brace, wherein said first vertical member, said second vertical member, said upper horizontal brace and said lower horizontal brace define a rectangular central aperture, and wherein one of said two frame components contains a plurality of looped members along one of its vertical members and the other of said two frame components contains a second plurality of looped members along one of its vertical members;

a locking shelf comprised of a first side having two parallel short sides, a long side perpendicular to said short sides having a plurality of looped members, and a diagonal long side having a plurality of looped members, a second side having two parallel short sides, a long side perpendicular to said short sides having a plurality of looped members, and a long diagonal side having a plurality of looped members, a first tubular member passing through said looped members on said perpendicular long sides forming a central hinge of said first and second sides and pivotally interconnecting said first side and said second side, a second tubular member passing through said looped members on said diagonal side of said first side and said looped members of said horizontal brace of said one frame component and pivotally interconnecting said one frame component with said first side of said shelf, and a third tubular member passing through said looped members on said diagonal side of said second side and said looped members of said horizontal brace of said other frame component and pivotally interconnecting said other frame component with said second side of said shelf; and a third tubular member passing through said plurality and said second plurality of looped members on respective vertical members and connecting said frame components in a V-shape at a 60 degree angle with said inner surfaces facing each other when said folding sawhorse is in a locked position, wherein said frame components pivot inwardly about said third tubular member to bring said inner surfaces in physical contact with each other.

14. The apparatus of claim 13 wherein said U-shaped load bearing supports each contain two exposed upper surfaces to be in physical contact with a work piece running the length of said frame components and forming a channel.

15. The apparatus of claim 13 wherein said locking shelf is trapezoidal.

16. The apparatus of claim 13 wherein each of said first side and said second side of said locking shelf are generally triangular.

17. The apparatus of claim 13 wherein each of said first side and said second side of said locking shelf contain a raised lip.

18. The apparatus of claim 13 wherein said horizontal supports are offset between said vertical supports.

19. The apparatus of claim 13 wherein said locking shelf folds between an open and closed position along said central hinge.

20. The apparatus of claim 13 wherein said frame components have an identical height and an identical length.

* * * * *